US005648621A

United States Patent [19]

Sasaki

[11] Patent Number: 5,648,621

[45] Date of Patent: Jul. 15, 1997

[54] AUTOMATIC PLAYER PIANO EXACTLY REPRODUCING MUSIC RECORDED ON OTHER MUSICAL INSTRUMENT

[75] Inventor: Tomoya Sasaki, Shizuoka, Japan

[73] Assignee: Yamaha Corporation, Japan

[21] Appl. No.: 565,390

[22] Filed: Nov. 30, 1995

[30] Foreign Application Priority Data

Dec. 1, 1994 [JP] Japan ..... 6-298511

[51] Int. Cl.[6] ..... G10C 5/00

[52] U.S. Cl. ..... 84/171; 84/462

[58] Field of Search ..... 84/171, 18, 20, 84/462, 719

[56] References Cited

U.S. PATENT DOCUMENTS

| | | | |
|---|---|---|---|
| 5,272,273 | 12/1993 | Watanuki et al. | 84/649 |
| 5,541,353 | 7/1996 | Kawamura et al. | 84/171 |
| 5,568,138 | 10/1996 | Mantani | 341/20 |

*Primary Examiner*—David S. Martin
*Assistant Examiner*—Marlon Fletcher
*Attorney, Agent, or Firm*—Graham & James LLP

[57] ABSTRACT

An automatic player piano is expected to exactly reproduce sounds generated in an original performance on the basis of music data codes, and a central processing unit incorporated in the automatic player piano increases initial forces exerted on a certain key to be quickly repeated in a playback so as to prevent the playback from a loss of sound.

10 Claims, 8 Drawing Sheets

AUTOMATIC PLAYER PIANO EXACTLY REPRODUCING MUSIC RECORDED ON OTHER MUSICAL INSTRUMENT

FIELD OF THE INVENTION

This invention relates to an automatic player piano and, more particularly, to an automatic player piano exactly reproducing a music recorded on another musical instrument.

DESCRIPTION OF THE RELATED ART

A standard automatic player piano is fabricated on the basis of an acoustic piano, and solenoid-operated actuators are provided for black and white keys incorporated in the acoustic piano so as to reproduce a music through sequentially pulling down the black and white keys.

FIG. 1 illustrates a typical example of the automatic player piano. Although FIG. 1 shows only one series of force transmission line from a key 1 to a hammer assembly 2, the prior art automatic player piano is equipped with eighty-eight sets of the force transmission lines, and the eighty-eight sets of the force transmission lines cause associated strings 3 to generate piano sounds for a music. The eighty-eight sets of the force transmission lines are similar to one another, and description is hereinbelow made on one of the force transmission line illustrated in FIG. 1.

The key 1 is swingably supported by a balance rail 1*a*, and the balance rail 1*a* is mounted on a key bed 4*a*. A balance key pin 1*b* projects from the balance rail 1*a*, and provides a fulcrum for the swing motion of the key 1. While a force is not exerted on the front portion of the key, i.e., the right side with respect to the balance key pin 1*b*, the key 1 remains in a rest position as indicated by the real line. However, when a force is exerted on the upper surface of the front portion of the key 1, the key 1 turns around the balance key pin 1*b* in the clockwise direction, and reaches an end position indicated by the dots-and-dash line. When the force is removed from the key 1, the key 1 returns to the rest position. A player exerts the force on the front portion of the key 1 during a fingering on the keyboard, and a solenoid-operated actuator 5 presses down the front portion of the key 1 in a playback mode of operation.

The solenoid-operated actuator 5 includes a solenoid coil housed in a case 5*a* coupled to a controller (not shown) and a plunger 5*b* projectable from the case 5*a* while current is flowing through the solenoid coil. When the current is cut off, a return spring (not shown) retracts the plunger 5*a* into the case 5*a*.

An key action mechanism 6 is provided between the key 1 and the hammer assembly 2, and converts an up-and-down motion of the rear portion of the key 1 to a rotation of the hammer assembly 2.

The key action mechanism 6 behaves as follows. While the key 1 is being pushed down from the rest position to the end position, the key la turns around the balance key pin 1*b* in the clockwise direction, and the capstan button 1*c* pushes up a whippen 6*a*. A whippen flange 6*b* turnably supports the left end portion of the whippen 6*a*, and the whippen flange 6*b* is fixed to a center rail 4*b*. The whippen flange 6*b* allows the whippen 6*a* to turn in the counter clockwise direction therearound, and a damper spoon 6*c* backwardly pushes a damper assembly 7. A damper lever 7*a* is rotated around a damper flange 7*b* against a damper spring 7*c*, and a damper head 7*d* is left from the associated string 3. Thus, the key action mechanism 6 firstly actuates the damper assembly 7, and causes the string 3 to freely vibrate.

The rotation of the whippen 6*a* in the counter clockwise direction further results in an escape of a jack 6*d* from a hammer butt 2*a* of the hammer assembly 2.

In detail, the jack 6*d* is turnably supported by a jack flange 6*e*, and is urges in the counter clockwise direction by a jack spring 6*f*. A regulating button 6*g* is supported by a fork screw 6*h*, and the fork screw 6*h* is connected to the center rail 4*b*. While the key 1 is staying in the rest position, the regulating button 6*g* is spaced from a toe 6*i* of the jack 6*d* by a predetermined distance.

The jack 6*d* has a generally L-shaped configuration, and the toe 6*i* is one end of the generally L-shaped configuration. The other end of the jack 6*d* is in contact with a butt skin 2*b* attached to the hammer but 2*a*, and the hammer butt 2*a* is turnably supported by a butt flange 2*c* fixed to the center rail 4*b*.

The jack 6*d* pushes the hammer butt 2*a*, and the hammer assembly 2 slowly turns around the butt flange 2*c* in the counter clockwise direction during the first stage of the rotation of the whippen 6*a*.

When the toe 6*i* is brought into contact with the regulating button 6*g*, the regulating button 6*g* restricts the rotation of the jack 6*d* around the whippen flange 6*b*, and causes the jack 6*d* to quickly turn around the jack flange 6*e* in the clockwise direction. The jack 6*d* escapes from the hammer butt 2*a*, and imparts a force to the hammer assembly 2 through the friction between the butt skin 2*b* and the jack 6*d*. As a result, the hammer assembly 2 starts to turn at high speed, and a hammer head 2*d* strikes the associated string 3. The string 3 vibrates, and generates the sound.

The hammer head 2*d* rebounds on the string 3, and returns toward the home position where a hammer shank 2*e* is held in contact with a hammer rail cloth 4*c*. A catcher 2*f* is brought into contact with a back-check 2*g* on the way to the home position. When the force is removed from the front portion of the key 1, the key 1 turns in the counter clockwise direction, and whippen 6*a* turns in the clockwise direction due to the self-weight. The toe 6*i* of the jack 2*d* is left from the regulating button 6*g*, and the jack spring 6*f* engages the jack 6*d* with the butt skin 2*b* again.

While the whippen 6*a* is turning in the clockwise direction, the damper spoon 6*c* decreases the force exerted on the damper lever 7*a*, and allows the damper head 7*d* to be brought into contact with the string 3 again. The damper head 7*d* takes up the vibrations of the string 3, and extinguishes the sound.

Thus, the force is transferred from the key 1 through the capstan button 1*c*, the whippen 6*a* and the jack 6*d* to the hammer assembly 2, and allows the hammer head 2*d* to strike the string 3. On the other hand, the jack 6*d* returns beneath the butt skin 2*b* again after the removal of the force from the key 1.

The hammer velocity is roughly proportional to the key velocity, and the hammer head 2*d* strikes against the string 3 with the force also roughly proportional to the key velocity. However, if the key 1 is pressed down again before the jack 2*d* is brought into engagement with the butt skin 2*b*, the jack 6*d* does not impart a force to the hammer assembly 2, and the prior art automatic player piano misses out a sound. Even if the jack 6*d* initiates the recovery to the engagement, the jack 6*d* escaping without a perfect recovery can not impart a force corresponding to the key velocity due to insufficient friction, and the hammer head 2*d* weakly impact the string 3. This results in an unexpected soft sound.

Thus, the key action mechanism is hardly responsive to a key depressed before the perfect recovery between the jack 6*d* and the butt skin 2*b*. However, this phenomenon is inherency, and players are familiar with the key action.

As described hereinbefore, driving signals are selectively supplied to the solenoid-operated actuators 5 in the playback, and FIG. 2 illustrates a controlling system 8 for the solenoid-operated actuators 5. The key velocity and the hammer velocity upon depressing a key 1 are hereinbelow referred to as "forward key velocity" and "forward hammer velocity", and "backward key velocity" and "backward hammer velocity" mean the key velocity and the hammer velocity after the release of the depressed key 1.

The controlling system 8 comprises a central processing unit 8*a* abbreviated as "CPU", a read-only memory 8*b* abbreviated as "ROM" and a random access memory abbreviated as "RAM" electrically connected through a shared bus system 8*d*. The central processing unit 8*a* successively fetches instruction codes forming a program sequence stored in the read only memory 8*b*, and the random access memory 8*c* serves as a temporary data storage for input/output data and a working memory for storing intermediate calculation results.

The controlling system 8 further comprises an interface connected between a sequencer 9 and the shared bus system 8*d*, a digital-to-analog converter 8*f* connected between the solenoid-operated actuators 5 and the shared bus system 8*d* and a timer 8*g* giving a timing for generation of a sound and extinguishment of the sound. The sequencer 9 sequentially supplies music data codes to the interface 8*e* in the playback mode, and the music data codes are formatted in accordance with the MIDI (Musical Instruments Digital Interface) standards.

The music data codes contain various musical information. Typical examples are a note-on for an initiation of sound generation and a note-off for a termination of the sound generation.

A key code and an on-velocity code are incorporated in the note-on, and respectively identify a sound pitch and a sound loudness to be generated. When the note-on is supplied to the automatic player piano, the automatic player piano determines a timing for the sound generation, and generates a sound with the specified pitch and the specified loudness at the timing.

On the other hand, the note-off includes a key code indicative of the sound pitch to be extinguished and an off-velocity indicative of a decrement of the loudness. When the note-off is supplied to the automatic player piano, the automatic player piano determines a timing for extinguishment of the sound, and starts to gradually decrease the sound specified by the key code at the speed specified by the off-velocity from at the timing.

Thus, the automatic player piano initiates a sound generation with the note-on, and terminates the sound in response to the note-off. For this reason, the note-on is paired with the note-off, and pairs of note-on/note-off define a music to be reproduced.

As described hereinbefore, the read only memory 8*b* stores the program sequence, and the central processing unit 8*a* sequentially forms a driving data code from the music data codes in the playback mode. The digital-to-analog converter 8*f* converts the driving data code to an analog driving signals, and the solenoid-operated actuator 8*f* controls the projecting/retracting plunger actions with the analog driving signal.

In order to form the driving data code, the read only memory 8*b* further stores a first table defining relation between the on-velocity and a touch-data/attack-delay as shown in FIGS. 3A and 3B. The touch-data is indicative of the potential level of the analog driving signal initiating the projection of the plunger 5*b*, and the attack-delay specifies a lapse of time from the initiation of the projecting plunger action to an impact of the hammer head 2*d* against the string 3.

The read only memory 8*b* further stores a second table defining relation between the off-velocity and a release data/release delay. The release data represents a magnitude of a counter force against the return spring accommodated in the case 5*a* at the release timing specified by the note-off, and the release delay specifies a lapse of time from the initiation of the retracting plunger action to the extinguishment of the sound.

The touch-data, the attack-delay, the release-data and the release delay form parts of the driving data code.

The relation between the on-velocity and the touch-data/attack-delay and the relation between the off-velocity and the release-data/release-delay are determined through experiments. Even if the hammer heads 2*d* strike different strings 3 at the same intensity, the strings 3 generate respective sounds different in pitch, and a listener feels the sounds different in loudness. For this reason, the relations are determined for each of the key codes, and the read only memory 8*b* stores eighty-eight sets of tables for the eighty-eight keys 1.

Assuming now that the sequencer 9 supplies a note-on and, thereafter, a note-off to the interface, the central processing unit 8*a* fetches the note-on, and extracts the on-velocity code. The central processing unit 8*a* checks the first table, and determines the touch-data. The touch-data is supplied through the shared bus system 8*d* to the digital-to-analog converter 8*f* associated with the key assigned the key code, and is converted to the analog driving signal. The analog driving signal is defined in correspondence to the on-velocity, and the plunger 5*a* starts the key 1 to turn under the force equivalent to the touch data. The key 1 turns at a forward key velocity in proportional to the force exerted by the plunger 5*b*, and the hammer assembly 2 is moved toward the string 3 at a forward hammer velocity proportional to the key velocity. The hammer head 2*d* strikes the string 3, and the intensity of the impact is proportional to the hammer velocity. The string 3 vibrates for generating a sound, and the loudness of the sound is proportional to the impact. Therefore, the loudness of the sound is dependent on the force exerted on the key 1, and is, accordingly, defined by the on-velocity.

As described hereinbefore, the sound is extinguished by the damper head 7*d*, and the damper head 7*d* is brought into contact with the string 3 again after the release of the depressed key 1. Therefore, the analog driving signal of a low potential is continuously supplied to the solenoid-operated actuator 5 after the impact against the string 3, and maintains the plunger 5*b* at the projected position against the elastic force of the return spring. For this reason, the key 1 is maintained in the end position.

When the central processing unit 8*a* fetches the note-off, the central processing unit 8*a* determines the release-data of the off-velocity by using the second table, and transfers the release data to the digital-to-analog converter 8*f*. The digital-to-analog converter 8*f* supplies the analog driving signal with a low potential to the solenoid-operated actuator 5, and gradually decreases the potential level of the analog driving signal in accordance with the release-delay. The solenoid-operated actuator 5 retracts the plunger 5*b* into the case 5*b* at the decrement of the potential level of the analog driving signal, and causes the key 1 to return toward the rest position. Accordingly, the damper spoon 6*c* is left from the damper lever 7*a*, and the damper spring 7*c* brings the damper head 7*d* into contact with the string 3 again. This results in the extinguishment of the sound.

If the note-on and the note-off represent a standard reciprocal key motion between the rest position and the end position, the original key motion is simply reproduced as described hereinbefore. The key 1 initiates the downward motion with the force expressed by the touch-data corresponding to the on-velocity, and the touch-data is enlarged together with the on-velocity (see FIG. 3A). As a result, the time interval from the initiation of the downward motion to the impact is shrunk in inversion to the on-velocity. Thus, the time interval is variable by using the on-velocity.

The extinguishment of a sound is a reverse process to the generation of the sound. The digital-to-analog converter 8*f* supplies the driving current corresponding to the off-velocity to the solenoid-operated actuator 5 so as to partially cancel the elastic force of the return spring. The analog driving signal allows the solenoid-operated actuator 5 to gradually retract the plunger 5*b*, and, accordingly, the depressed key 1 returns toward the rest position. The key 1 allows the damper spoon 6*c* to bring the damper head 7*d* into contact with the string 3 on the way to the rest position, and the backward key velocity is defined by the off-velocity. This means that the off-velocity varies the time interval from the initiation of the release to the extinguishment of the sound.

The sequencer 9 simply supplies the music data codes with the lapse of time, and the prior art automatic player piano internally gives a timing for the sound generation and a timing for the extinguishment of the sound. In detail, when the central processing unit 8*a* fetches the note-on and the note-off, the central processing unit 8*a* starts the timer 8*g*, and introduces a predetermined time delay of 0.5 second so as to determine the timings.

FIG. 4 illustrates the function of the sound generation/extinguishment. The sequencer 9 supplies the interface 8*e* the first note-on at time N1, the first note-off at time F1, the second note-on at time N2 and the second note-off at time F2, respectively, and the on-velocity NV1 and the off-velocity FV1 of the first note-on are assumed to be smaller than the on-velocity NV2 and the off-velocity FV2 of the second note-on. The first note-on/ the first note-off and the second note-on/ the second note-off define a first sound and a second sound, respectively.

Upon receipt of the note-on/note-off, the central processing unit 8*a* starts the timer 8*g*, and determines the first sound generation/first sound extinguishment at times N1' and F1' for the first sound and the second sound generation/second sound extinguishment at times N2' and F2' for the second sound.

When the first note-on is fetched, the central processing unit 8*a* accesses the first table in the read only memory 8*b*, and determines a first key code of the first sound to be generated at time N1' and the first touch data T1 and the first attack delay A1 corresponding to the on-velocity NV1. The central processing unit subtracts the attack delay A1 from the time N1' for the sound generation, and determines an initiative timing I1 for the plunger projection. If the time reaches the initiative timing I1, the central processing unit 8*a* supplies the driving data code equivalent to the touch-data T1 to the digital-to-analog converter 8*f*, and the digital-to-analog converter 8*f* supplies the driving current corresponding to the driving data code to the solenoid-operated actuator 5 associated with the key 1 assigned the first key code. Then, the key 1 assigned the first key code starts to sink from the rest position at time I1, and, accordingly, the hammer assembly 2 starts the rotation toward the string 3. The key 1 is sinking over the time I1, and the hammer head 2*d* strikes the string 3 at time N1'. The key 1 reaches the end position immediately after time N1'. The string 3 vibrates so as to generates the first sound.

After the impact, the central processing unit 8*a* decreases the value of the driving data code to "M", and the solenoid-operated actuator 5 keeps the key 1 at the end position. On the other hand, the hammer assembly 2 rebound on the string 3, and returns toward the home position. The backward hammer velocity is roughly in proportion to the forward hammer velocity.

The central processing unit 8*a* fetches the first note-off at time F1, and determines the first key code and the release data U1 and the release delay B1 on the basis of the relation described in the second table. The central processing unit 8*a* subtracts the release delay B1 from the timing F1' 0.5 second later than the time F1, and determines an initiative timing J1 for the plunger retraction.

If the time reaches the initiative timing J1, the central processing unit 8*a* decreases the value of the driving data code to that of the release data U1. The digital-to-analog converter 8*f* decreases the potential level of the analog driving signal, and the solenoid-operated actuator 5 decreases the electro-magnetic force corresponding to the potential level of the analog driving signal. The electro-magnetic force is smaller than the elastic force of the return spring, and the solenoid-operated actuator 5 starts to retract the plunger 5*b*. As a result, the depressed key 1 is recovered from the end position at time J1, and the backward key velocity is corresponding to the difference between the elastic force and the electro-magnetic force.

The key 1 allows the damper spoon 6*c* to bring the damper head 7*d* into contact with the string 3 at time F1', and, accordingly, the first sound is extinguished at time F1'.

The sound generation/sound extinguishment process for the second sound is similar to that of the first sound. As described hereinbefore, the on-velocity NV2 is assumed to be larger than the on-velocity NV1. This means that the touch-data T2 is larger than the touch-date T1, and the attack-delay A2 is shorter than the attack-delay A1. Moreover, the off-velocity FV2 is assumed to be larger than the off-velocity FV1. Therefore, the release data U2 is smaller than the release data U1, and, accordingly, the release delay B2 is shorter than the release delay B1. The central processing unit 8*a* tailors the driving data code corresponding to the touch-data T2 and the release data U2, and changes the driving data code at the initiative timings I2 and J2.

The central processing unit 8*a* controls the driving data codes for the eighty-eight keys 1, and the solenoid-operated actuator units 5 cause the strings 3 to generate the sounds at 0.5 second later than the data fetches of the music data codes.

However, a problem is encountered in the prior art automatic player piano in that sounds recorded through a quick repetition are liable to be lost from the playback. In detail, a set of music data codes is not always formed from an original performance on the same automatic player piano. Another musical instrument may repeat a sound at time intervals less than 0.5 second, and the music data codes recorded from the musical instrument specify the note-on events at time intervals t less than 0.5 second as shown in FIG. 5. The first note-on, the second note-on and the third note-on are supplied from the sequencer 9 to the interface 8*e* at time N10, N11 and N12, and the first note-off, the second note-off and the third note-off are fetched at time F10, time F11 and time F12, respectively. The central processing unit 8*a* calculates the initiative timings I10, I11 and I12, and changes the driving data code to the value corresponding to the touch-data at times I10, I11 and I12. Although the key 1 is reciprocally moved by the plunger 5*b*, the hammer assembly 2 can not follow the key motion. As a result, the second sound is generated at time N11" after the correct timing N11', and the third sound is lost at time N12'. Thus, the prior art automatic player piano is hardly responsive to the quick repetition, and can not exactly reproduce the original performance.

SUMMARY OF THE INVENTION

It is therefore an important object of the present invention to provide an automatic player piano which exactly reproduce an original performance on another musical instrument.

To accomplish the object, the present invention proposes to check music data codes to see whether or not a hammer assembly can repeatedly generate an acoustic sound on the basis of the on-velocities. If impossible, the on-velocities are modified so as to generate the acoustic sound at the given timings.

In accordance with one aspect of the present invention, there is provided an automatic player piano comprising: an acoustic piano including a plurality of keys respectively assigned notes of a scale and selectively depressed by a player, a plurality of hammer assemblies respectively associated with the plurality of keys, a plurality of strings respectively associated with the plurality of hammer assemblies and generating acoustic sounds respectively having the notes, and a plurality of key action mechanisms functionally connected between the plurality of keys and the plurality of hammer assemblies and transferring forces exerted on the plurality of keys so as to cause the plurality of hammer assemblies to strike the plurality of strings; and an electric system including a plurality of actuators respectively associated with the plurality of keys and selectively energized so as to exert the forces on the plurality of keys instead of the player, and a controlling unit selectively supplying driving signals to the plurality of actuators for selectively energizing the plurality of actuators, and having a source of music data information sequentially generating first pieces of music data information indicative of respective keys to be depressed and magnitudes of the forces and second pieces of music data information indicative of the respective keys to be released and decrements of the forces, a forecasting means enabled with at least two first pieces of music data information both indicative of a certain key of the plurality of keys to be depressed and deciding whether or not one of the plurality of strings associated with the certain key can repeatedly generate the acoustic sound on the basis of the magnitudes of the at least two first pieces of music data information, a modifying means for changing the magnitudes of the at least two first pieces of music data information when the forecasting means decides that the one of the plurality of strings can not repeatedly generates the acoustic sound, and a driving signal generating means responsive to the first pieces of music data information for changing the driving signals to respective values corresponding to the magnitudes and the second pieces of music data information for decreasing the magnitudes by the decrements.

In accordance with another aspect of the present invention, there is provided an automatic player piano comprising: an acoustic piano including a plurality of keys respectively assigned notes of a scale and selectively depressed by a player, a plurality of hammer assemblies respectively associated with the plurality of keys, a plurality of strings respectively associated with the plurality of hammer assemblies and generating acoustic sounds respectively having the notes, and a plurality of key action mechanisms functionally connected between the plurality of keys and the plurality of hammer assemblies and transferring forces exerted on the plurality of keys so as to cause the plurality of hammer assemblies to strike the plurality of strings; and an electric system including a plurality of actuators respectively associated to exert the forces on the plurality of keys instead of the player, and a controlling unit selectively supplying driving signals to the plurality of actuators for selectively energizing the plurality of actuators, and having a source of music data information sequentially generating first pieces of music data information indicative of respective keys to be depressed and magnitudes of the forces and second pieces of music data information indicative of the respective keys to be released and decrements of the forces, a forecasting means enabled with at least two first pieces of music data information both indicative of a certain key of the plurality of keys to be depressed and deciding whether or not one of the plurality of strings associated with the certain key can repeatedly generates the acoustic sound on the basis of the magnitudes of the at least two first pieces of music data information, a modifying means for changing the decrements of at least two second pieces of music data information relating to the at least two first pieces of music data information to a maximum value when the forecasting means decides that the one of the plurality of strings can not repeatedly generates the acoustic sound, and a driving signal generating means responsive to the first pieces of music data information for changing the driving signals to respective values corresponding to the magnitudes and the second pieces of music data information for decreasing the magnitudes by the decrements changed to the maximum value.

In accordance with yet another aspect of the present invention, there is provided an automatic player piano comprising: an acoustic piano including a plurality of keys respectively assigned notes of a scale and selectively depressed by a player, a plurality of hammer assemblies respectively associated with the plurality of keys, a plurality of strings respectively associated with the plurality of hammer assemblies and generating acoustic sounds respectively having the notes, and a plurality of key action mechanisms functionally connected between the plurality of keys and the plurality of hammer assemblies and transferring forces exerted on the plurality of keys so as to cause the plurality of hammer assemblies to strike the plurality of strings; and an electric system including a plurality of actuators respectively associated with the plurality of keys and selectively energized so as to exert the forces on the plurality of keys instead of the player, and a controlling unit selectively supplying driving signals to the plurality of actuators for selectively energizing the plurality of actuators, and having a source of music data information sequentially generating first pieces of music data information indicative of respective keys to be depressed and magnitudes of the forces and second pieces of music data information indicative of the respective keys to be released and decrements of the forces, a forecasting means enabled with at least two first pieces of music data information both indicative of a certain key of the plurality of keys to be depressed and deciding whether or not one of the plurality of strings associated with the certain key can repeatedly generates the acoustic sound on the basis of the magnitudes of the at least two first pieces of music data information, a first modifying means for changing the magnitudes of the at least two first pieces of music data information when the forecasting means decides that the one of the plurality of strings can not repeatedly generates the acoustic sound, a second modifying means for changing the decrements of at least two second pieces of music data information relating to the at least two first pieces of music data information to a maximum value when the forecasting means decides that the one of the plurality of strings can not repeatedly generates the acoustic sound, and a driving signal generating means responsive to the first pieces of music data information for changing the driving signals to respective values corresponding to the magnitudes and the second pieces of music data information for decreasing the magnitudes by the decrements.

BRIEF DESCRIPTION OF THE DRAWINGS

The features and advantages of the automatic player piano according to the present invention will be more clearly understood from the following description taken in conjunction with the accompanying drawings in which.

DESCRIPTION OF THE PREFERRED EMBODIMENT

Structure of Automatic Player Piano

Figure 1:
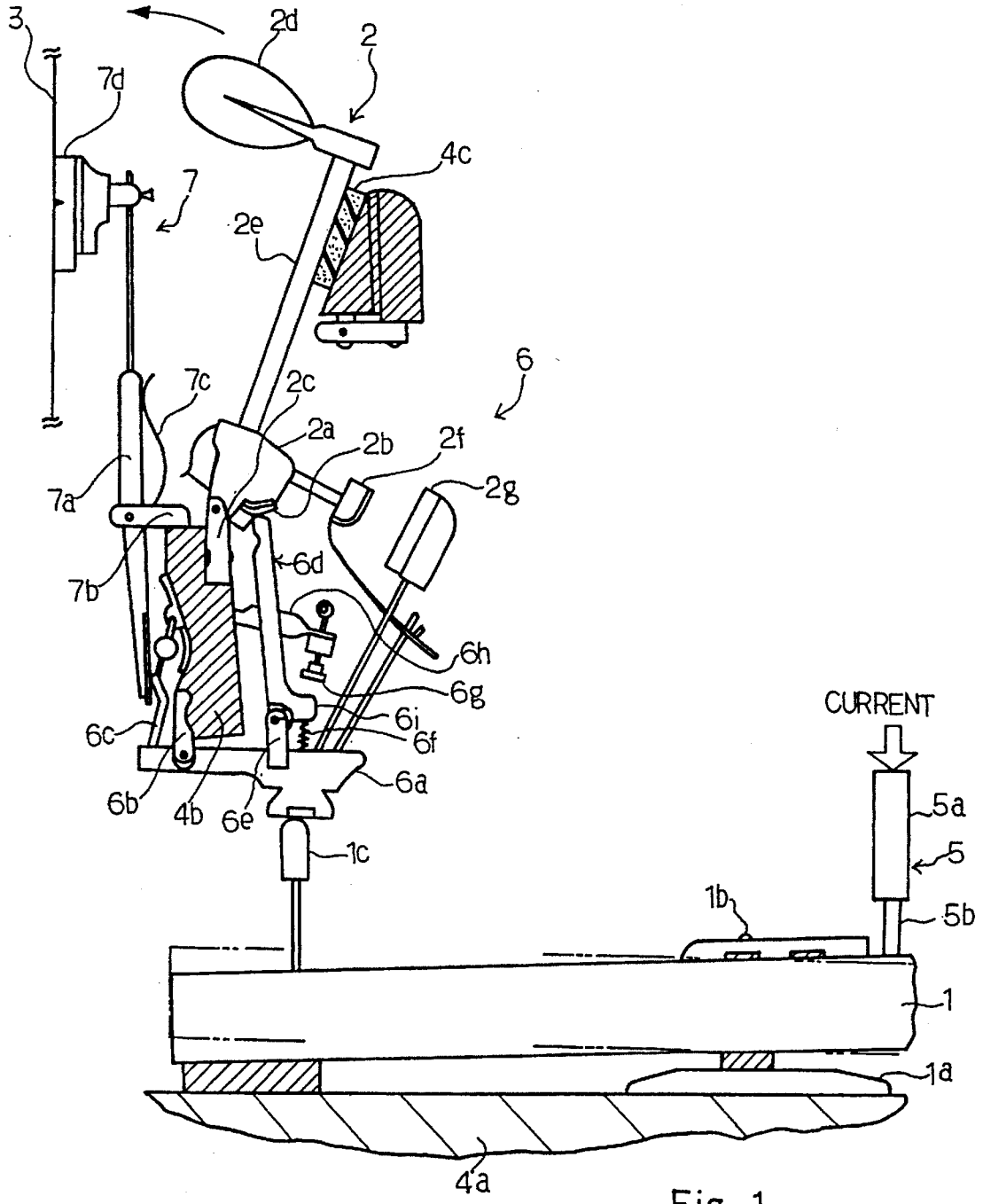
Fig. 1 PRIOR ART
FIG. 1 is a side view showing the structure of the prior art automatic player piano.
Figure 6:
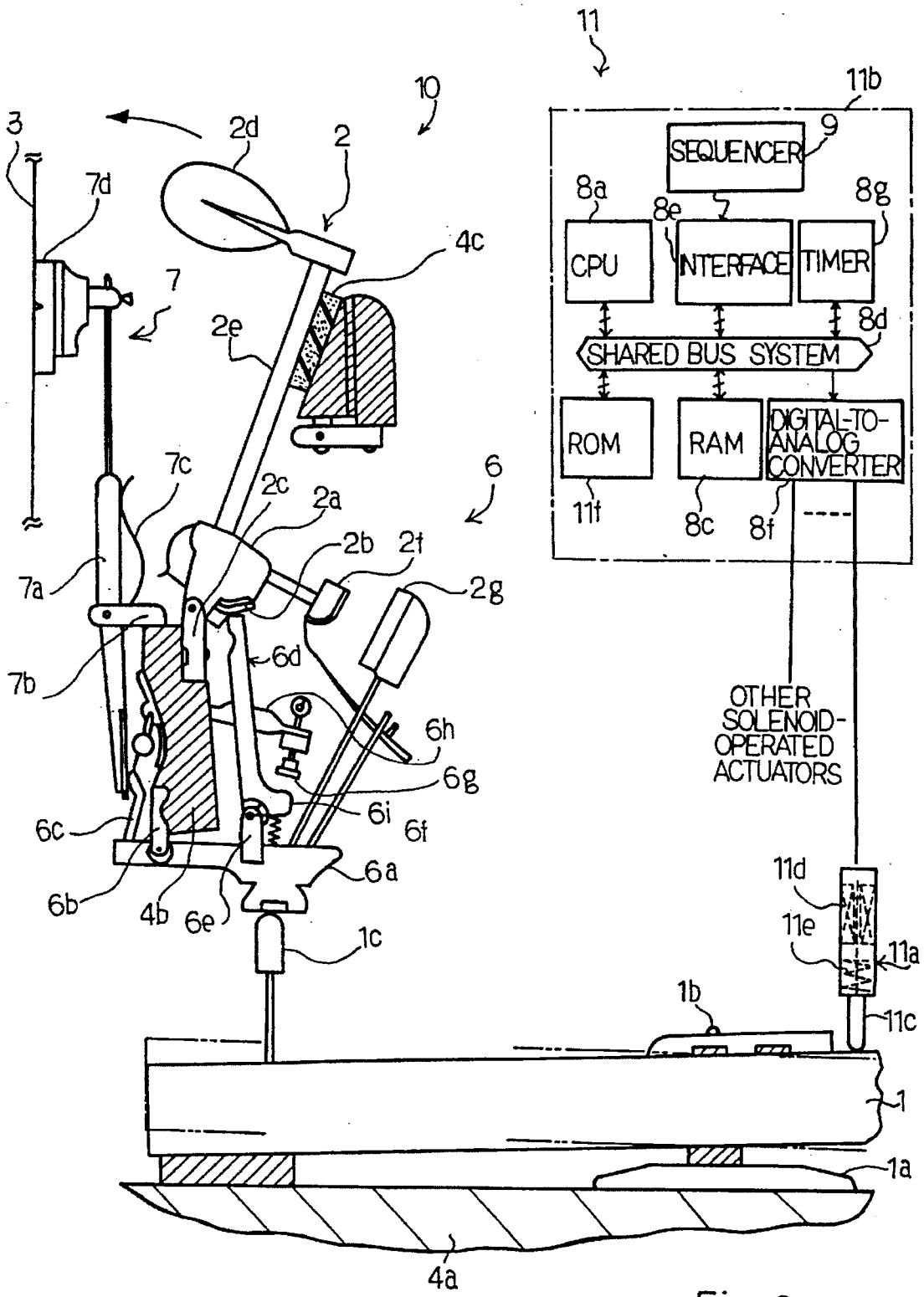
FIG. 6 is a side view showing the structure of an automatic player piano according to the present invention.

Referring to FIG. 6 of the drawings, an automatic player piano embodying the present invention largely comprises an upright piano 10 and an electronic system 11. The upright piano 10 is constructed as similar to the upright piano shown in FIG. 1, and parts and members of the upright piano 10 are labeled with the same references designating the corresponding parts and the members in FIG. 1.

Figure 2:
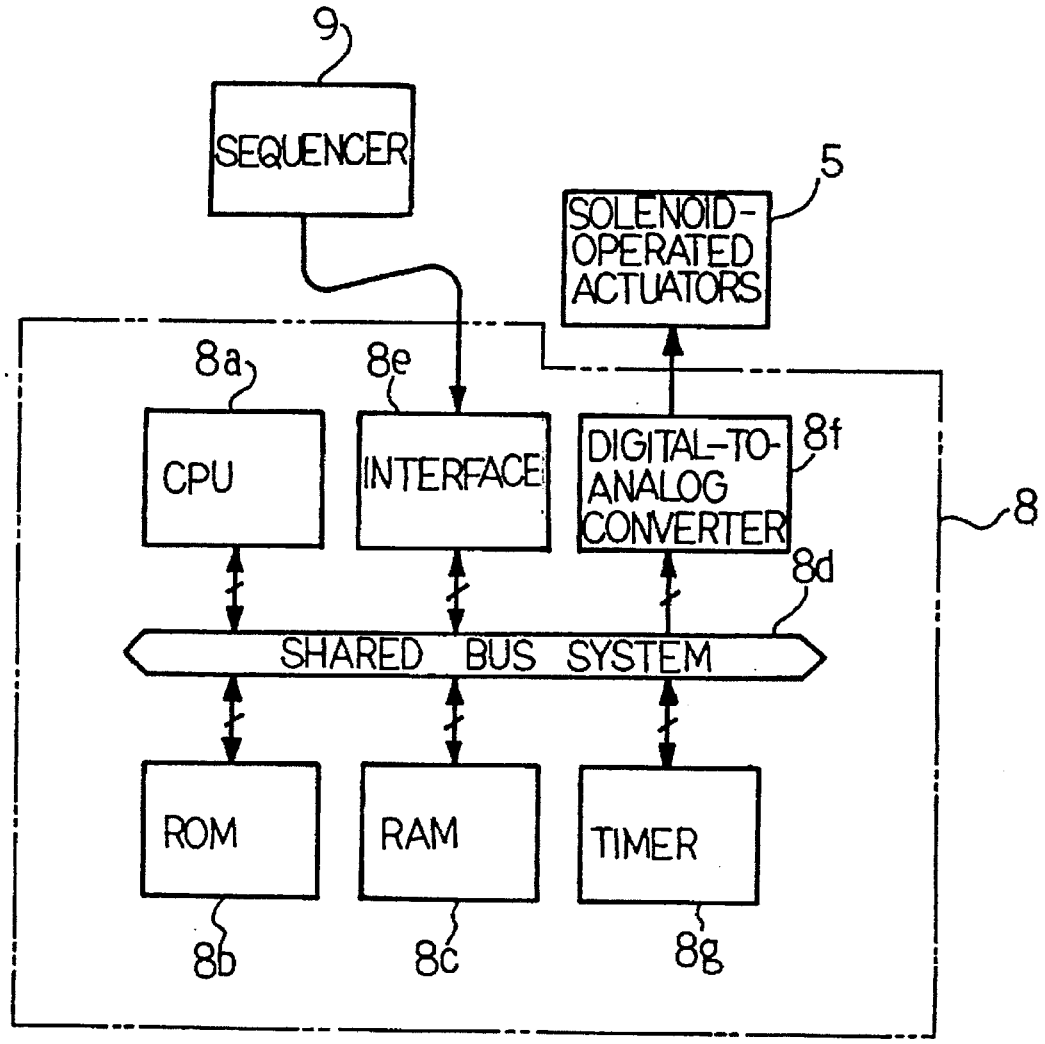
Fig·2 PRIOR ART
FIG. 2 is.

The electronic system includes a plurality of solenoid-operated actuators 11*a* respectively associated with the black and white keys 1 of the upright piano 10 and a controlling unit 11*b*. The solenoid-operated actuators 11*a* are similar to the solenoid-operated actuator 5, and a plunger, a solenoid-coil and a return spring are designated by the same references 11*c*, 11*d* and 11*e*. The controlling unit has the same circuit arrangement as shown in FIG. 2. However, the contents of the read only memory 11*f* are different from those of the read only memory cell 8*b*, and the other components are labeled with the same references without detailed description.

The read only memory 11*f* stores instruction codes forming a program sequence, the first table defining the relation between the on-velocity and the touch-data/attack-delay and the second table defining the relation between the off-velocity and the release data/release delay. Although the first table and the second table are identical with those stored in the read only memory 8*b*, the program sequence is improved so as to cope with the problem inherent in the prior art automatic player piano.

Program Sequence

Figure 7:
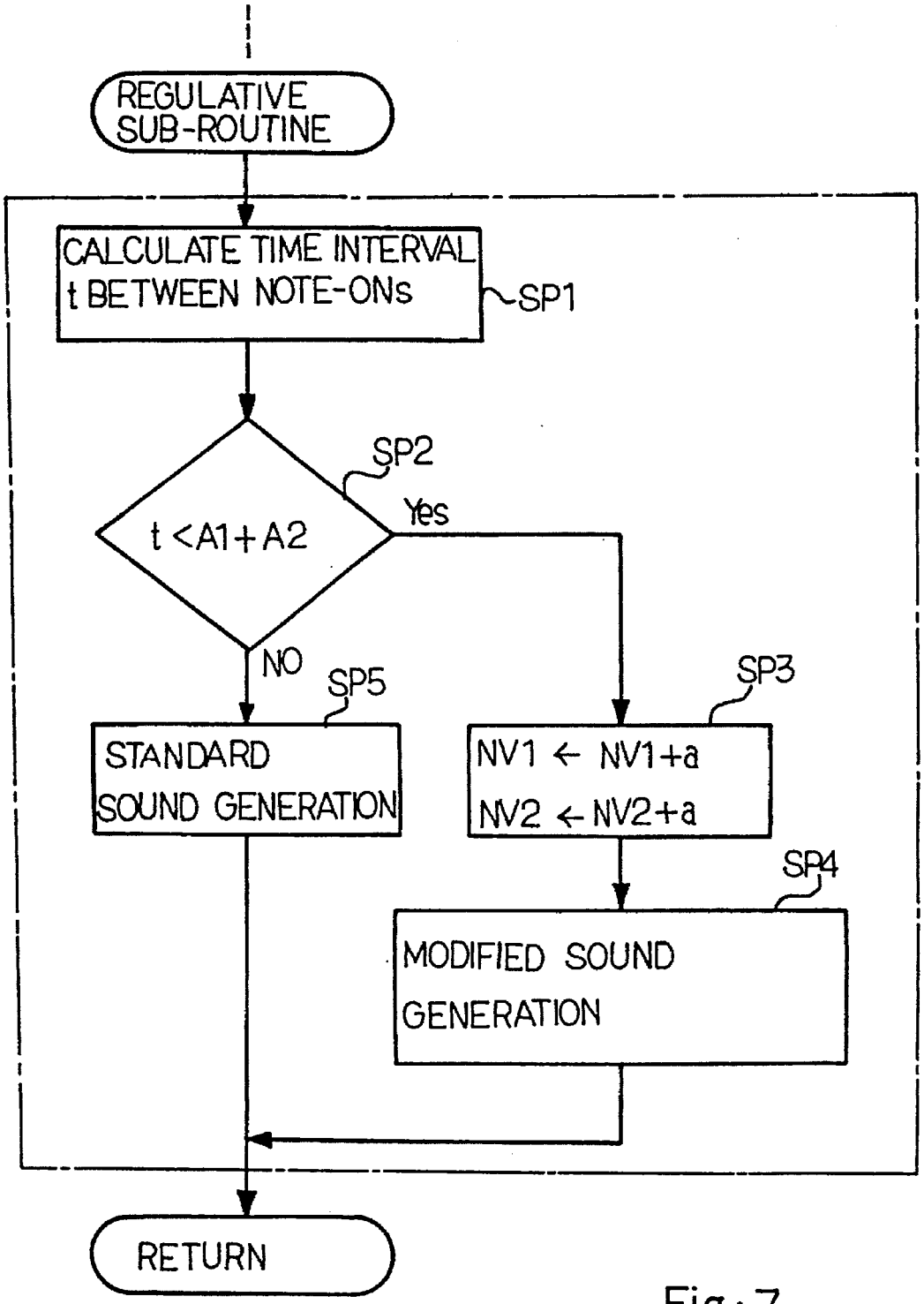
FIG. 7 is a flow chart showing a program sequence executed by a central processing unit incorporated in the automatic player piano according to the present invention.

The program sequence contains a sub-program executed upon receipt of an note-on, and a regulative sub-routine consisting of steps SP1 to SP5 is newly added to the sub-program as shown in FIG. 7. Though not shown in the drawings, the main routine sub-program and the other sub-programs are identical with those of the prior art automatic player piano.

The behavior of the automatic player piano is outlined as follows. The sequencer 9 successively supplies the music data codes to the interface 8*e*. The central processing unit 8*a* periodically checks the interface 8*e* to see whether or not a music data code arrives at the interface. If a music data code is supplied from the sequencer 9, the central processing unit 8*a* fetches the music data code, and changes the value of the driving data code for controlling the solenoid-operated actuator 11*a* associated with the key assigned the key code. The key codes respectively specify notes of a scale.

Figure 3A:
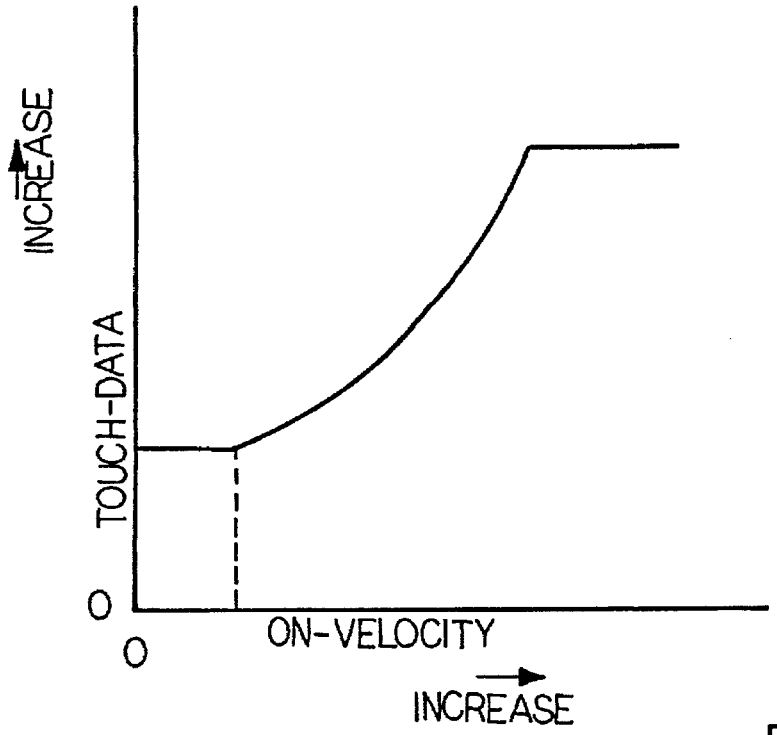
Fig·3A PRIOR ART
FIGS. 3A and 3B are graphs showing the relations between the on-velocity and the touch-data/attack-delay.
Figure 3B:
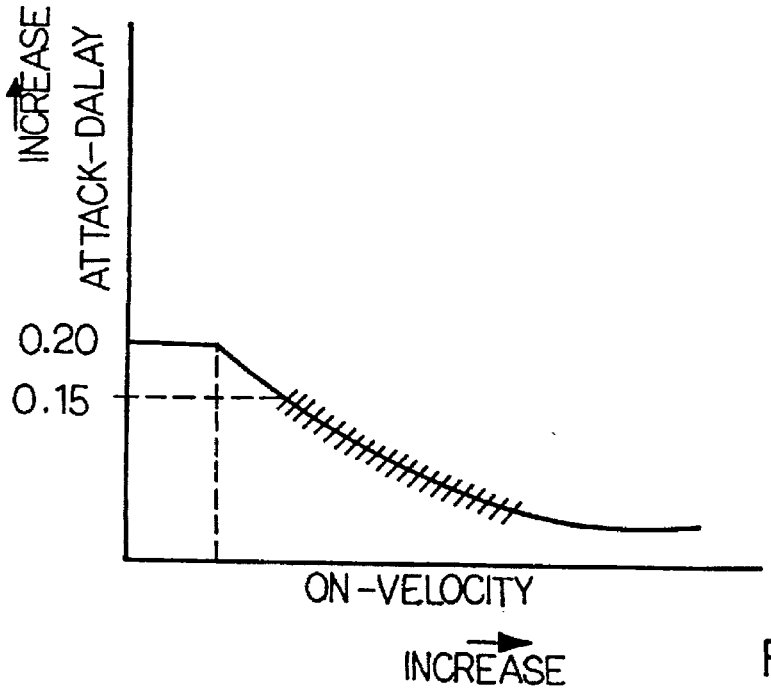
Fig·3B PRIOR ART
Figure 4:
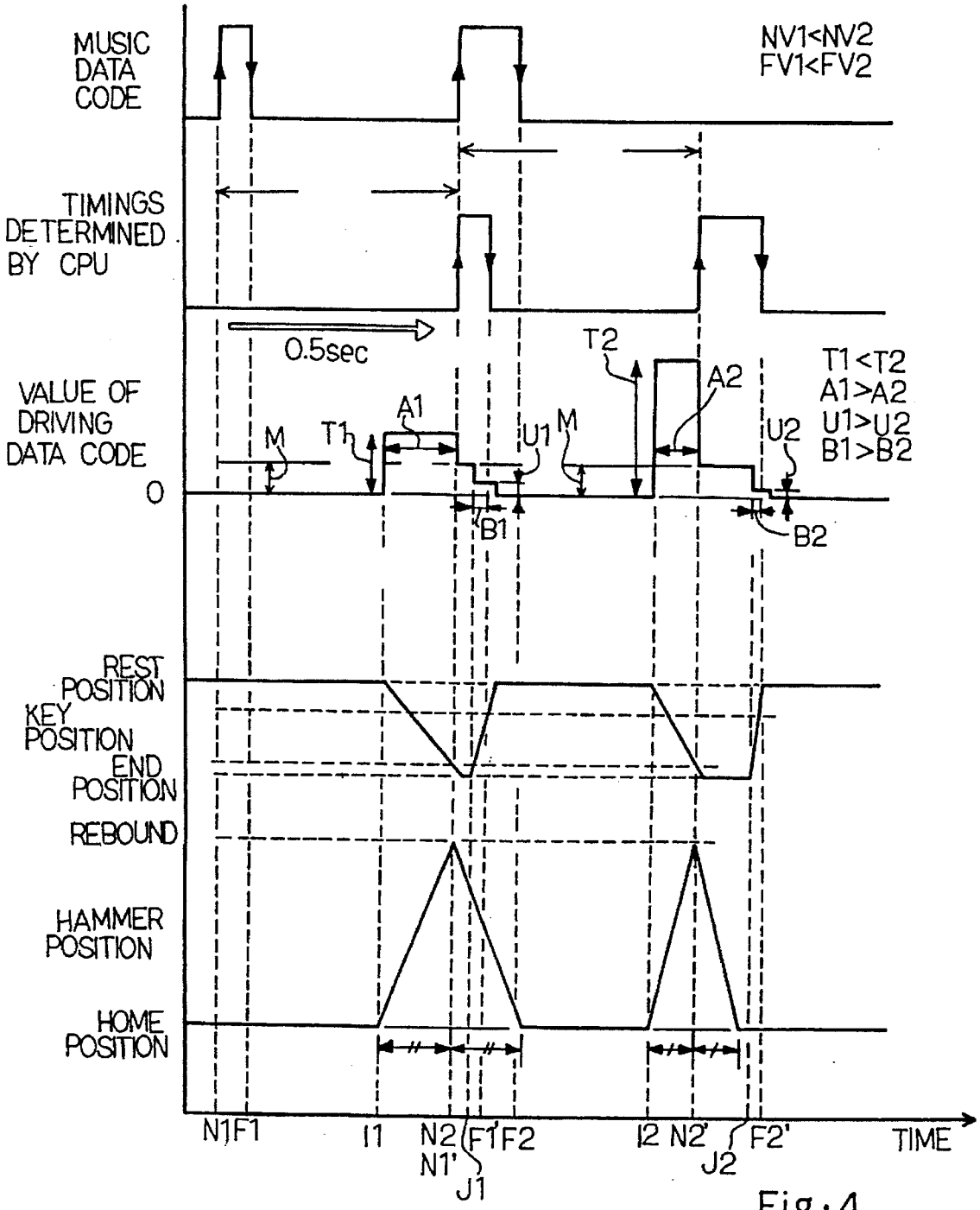
Fig. 4 PRIOR ART
FIG. 4 is a timing chart showing the sound generation/sound extinguishment process.
Figure 5:
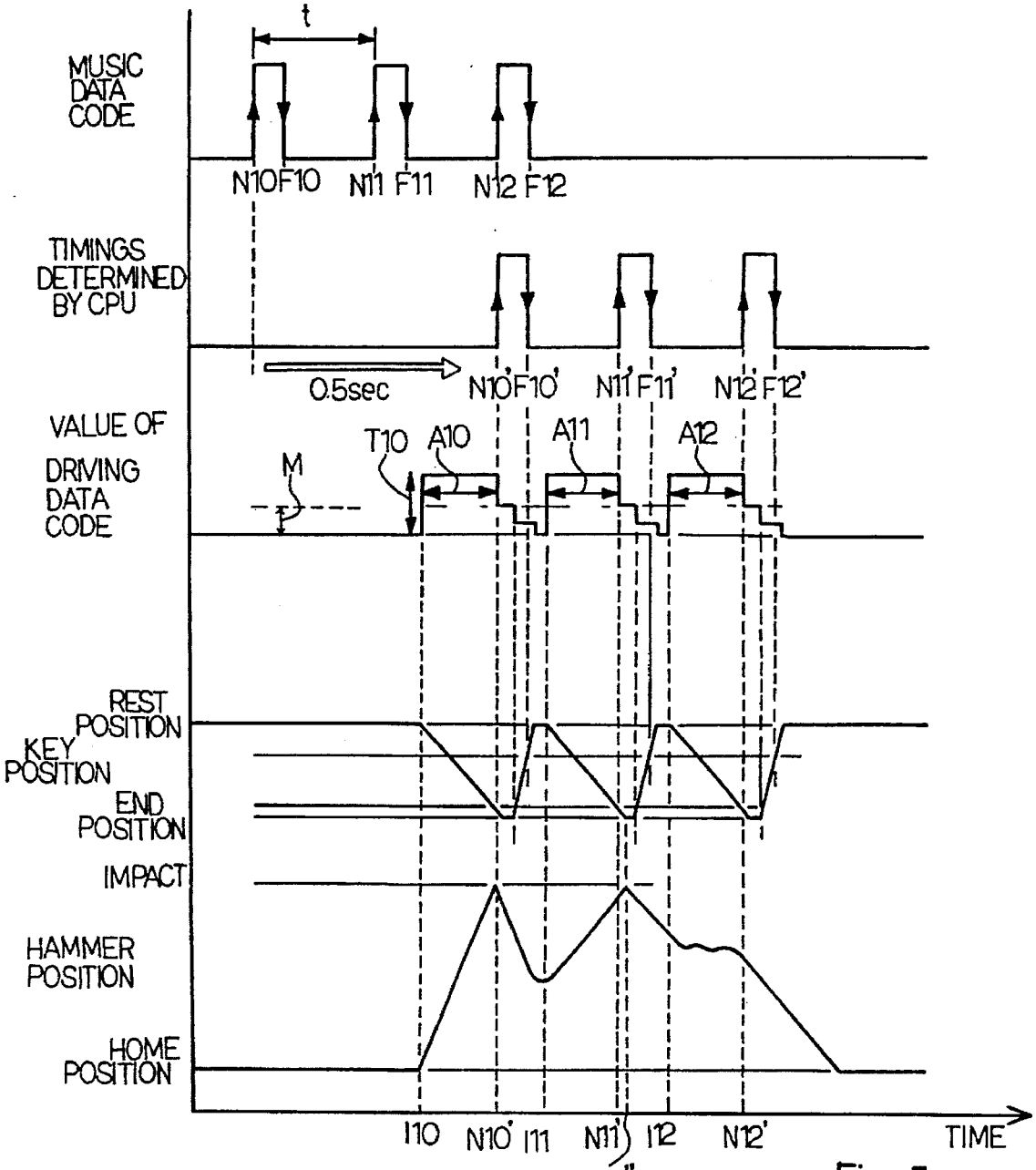
Fig·5 PRIOR ART
FIG. 5 is a timing chart showing the problem inherent in the prior art automatic player piano.

If the music data code is a note-on, the central processing unit 8*a* identifies the key 1 to be depressed, and determines the touch-data/attack delay on the basis of the first table stored in the read only memory 11*f* (see FIGS. 3A and 3B). The central processing unit calculates an initiative timing for the plunger projection, and changes the driving data code to the value corresponding to the touch data at the initiative timing. The driving data code is supplied to the digital-do-analog converter 8*f*, and is converted to the analog driving signal corresponding to the touch data. The analog driving signal is supplied to the solenoid-operated actuator 11*a* associated with the key 1 assigned the key code, and the solenoid-operated actuator 11*a* generates the electro-magnetic force corresponding to the potential level of the analog driving signal. The plunger 11*c* projects from the case, and exerts the force corresponding to the touch data on the key 1.

The key 1 transfers the force through the key action mechanism 6 to the hammer assembly 2, and the hammer head 2*d* strikes the string 3 so as to generate a sound.

On the other hand, if the music data code is a note-off, the central processing unit 8*a* identifies the key 1 to be released, and determines the release data and the release delay on the basis of the second table defining the relation between the off-velocity and the release data/release delay. The central processing unit 8*a* determines an initiative timing for the plunger retraction, and decreases the driving data code to the value corresponding to the release data.

The digital-to-analog converter 8*f* converts the driving data code to the analog driving signal, and the electro-magnetic force is decreased to the value corresponding to the potential level of the analog driving signal. The decreased electro-magnetic force is smaller than the elastic force of the return spring 11*e*, and the return spring 11*c* gradually retracts the plunger 11*c*. The depressed key 1 returns toward the rest position at the backward key velocity corresponding to the release data.

While the central processing unit 8*a* is sequentially executing the sub-program, more than one note-on with the same key code may be supplied to the interface 8*e* within a time delay introduced into the sound generation. In this instance, the time delay is 0.5 second. The central processing unit 8*a* forecasts a possibility of a loss of sound, and branches the sub-program to the regulative sub-routine. Although the central processing unit 8*a* does not change the initiative timings for the sound generation, the central processing unit 8*a* modifies the other control data so as to generate all the sounds respectively specified by the note-on codes.

In detail, when the note-on identical in key code with the previous note-on is newly fetched by the central processing unit 8*a* within the time delay introduced into the sound generation, the central processing unit 8*a* calculates the time interval t between the newly fetched note-on and the previous note-on as by step SP1. The timer 8*g* may be used for the calculation. The sound generation has not been initiated for the previous note-on yet, and the sound generation is modifiable.

The central processing unit 8*a* proceeds to step SP2. The central processing unit 8*a* firstly adds the attack delay A1 of the previous note-on to the attack delay A2 of the newly fetched note-on, and compares the total time interval of the attack delays A1 and A2 with the time interval t. If the total time interval (A1+A2) is shorter than the time interval t, the answer at step SP2 is given negative, and the central processing unit 8*a* decides that the sound will be not lost. Then, the central processing unit 8*a* proceeds to step SP5, and treats the previous note-on and the newly fetched note-on with the standard sound generation process as described hereinbefore. In other words, the on-velocity and the off-velocity are used for the driving data code without a modification.

On the other hand, if the total time interval (A1+A2) is longer than the time interval t, the answer at step SP2 is given affirmative, and the central processing unit 8*a* forecasts the loss of sound.

In general, it is necessary that the time interval t is not shorter than the total of first time consumed by the backward motion of the hammer assembly 2 from the impact to the home position and second time consumed by the forward motion of the same hammer assembly 2 from the home position to the impact. The first time and the second time are measured in the fingering for the staccato.

As described hereinbefore, the backward hammer velocity is roughly equal to the forward hammer velocity, and, accordingly, the first time is equal to the second time. For this reason, the attack delay A1 is equal to the first time consumed by the backward motion of the hammer assembly 2, and the total of the attack delays A1 and A2 represents the total time consumed by the reciprocal motion of the hammer assembly 2. If the time interval t is longer than the total time of the attack delays (A1+A2), the time interval t is long enough to be consumed by the reciprocal motion of the hammer assembly 2, and no sound is lost. However, if the time interval t is shorter than the total time (A1+A2), the hammer assembly is expected to strike the string before the possible impact timing, and the sound generation is either delayed or missed.

If the loss of sound is forecasted at step SP2, the central processing unit 8*a* proceeds to step SP3, and adds a constant value a to the on-velocity NV1 of the previous note-on and the on-velocity NV2 of the newly added note-on. As described hereinbefore, the attack-delay is inversely proportional to the force exerted on the key which is proportional to the value of the on-velocity. Therefore, the total time (A1+A2) is shrunk.

Upon completion of the work at step SP3, the central processing unit 8*a* proceeds to step SP4 for a modified sound generation. In detail, the central processing unit 8*a* determines the touch-data and the attack-delay corresponding to each modified on-velocity on the basis of the first table. The central processing unit 8*a* calculates the initiative timings for the sound generation. When the time reaches the early initiative timing for the sound generation, the central processing unit 8*a* changes the driving data code to the value corresponding to the touch data for the first modified on-velocity NV1, and continues the driving data code for the time period equivalent to the attack-delay. When the time period is expired, the hammer head 2*d* strikes the string 3, and the central processing unit 8*a* changes the driving data code to zero regardless of the off-velocity. The depressed key 1 quickly returns toward the rest position, and, accordingly, the hammer assembly 2 and the damper assembly 7 go back to the respective home positions. When the later initiative timing comes, the central processing unit 8*a* changes the driving data code to the value corresponding to the touch data for the second modified on-velocity NV2, and continues the driving data code for the time period equivalent to the attack-delay. When the time period is expired, the hammer head 2*d* strikes the string 3, and the central processing unit 8*a* changes the driving data code to zero again regardless of the off-velocity. The depressed key 1 quickly returns toward the rest position, and, accordingly, the hammer assembly 2 and the damper assembly 7 go back to the respective home positions.

Figure 8:
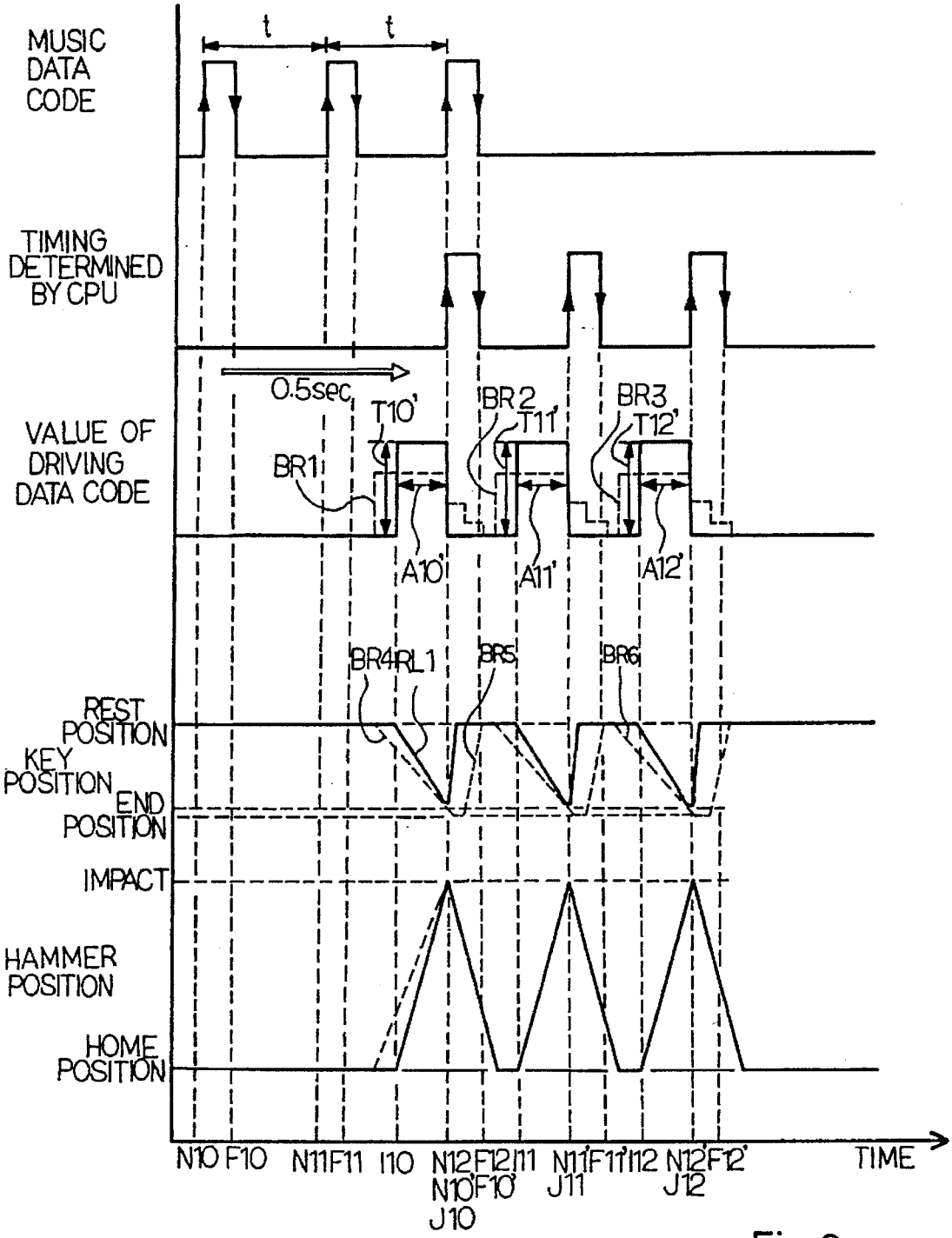
FIG. 8 is a timing chart showing a process of sound generation/sound extinguishment.

FIG. 8 illustrates the modified sound generation. Assuming now that the sequencer 9 supplies the music data codes each indicative of the note-on at times N10, N11 and N12 and the music data codes each indicative of note-off at times F10, F11 and F12. The note-on codes at N10, N11 and N12 and the note-off codes at time F10, F11 and F12 are hereinbelow referred to as "first note-on", "second note-on", "third note-on", "first note-off", "second note-off" and "third note-off", respectively.

The first to third note-on codes and the first to third note-of codes are assumed to specify one of the eighty-eight keys 1. The first to third note-on codes have respective on-velocities NV1, NV2 and NV3, and the first to third note-off codes have respective off-velocities FV1, FV2 and FV3.

The first to third note-on codes are supplied from the sequencer 9 at intervals of t shorter than 0.5 second. Therefore, if the central processing unit 8*a* changes the driving data code without the modification, the value of the driving data code traces broken lines BR1, BR2 and BR3, and the key 1 is moved along broken lines BR4, BR5 and BR6. The automatic player piano tries to strike the string 3 at time N10', N11' and N12' and extinguish the sound at time F10', F11' and F12'. The hammer assembly 2 hardly follows the key motion, and a loss of sound takes place.

However, the central processing unit 8*a* forecasts the loss of sound as by step SP2, and branches the sequence to step SP3 in accordance with the present invention. The central processing unit 8*a* adds the constant value a to the on-velocities NV1, NV2 and NV3, and determines the modified on-velocities NV1', NV2' and NV3' larger in value than the original on-velocities NV1, NV2 and NV3, respectively.

The modified on-velocities NV1', NV2' and NV3' result in touch-data T10', T11' and T12' larger in value than those of the original on-velocities NV1, NV2 and NV3 and attack-delays A10', A11' and A12' shorter than those of the original on-velocities NV1, NV2 and NV3. The central processing unit 8*a* ignores the off-velocities FV1, FV2 and FV3, and rapidly changes the driving data code to zero at the initiative timings for sound extinguishment J10, J11 and J12. As a result, the value of driving data code forms square wave.

The digital-to-analog converter 8*f* converts the driving data code in the form of square wave to the driving signal, and the solenoid-operated actuator 11*a* associated with the key 1 assigned the key code moves the key 1 as indicated by real line RL1.

As will be understood through the comparison between the broken lines BR1 to BR3 and the real line RL1, the key 1 is exactly sunk at the initiative timings I10, I11 and I12, and quickly returns toward the rest position at the initiative timings J10, J11 and J12. The backward key velocity is much larger than that of the key 1 driven with the original off-velocities, and the quick backward key motion allows the damper head 7*d* to be brought into contact with the strings 3 before the initiative timings I11 and I12. Moreover, the quick backward key motion allows the hammer assembly 2 to enter ready for strike state well before the initiative timings I11 and I12, and the hammer head d repeatedly strikes the string 3 at time N11' and N12' without a loss of sound.

Although the impacts against the string 3 are larger than those instructed by the first to third note-on codes, the hammer head 2*d* exactly strikes the string 3 for generating the sound, and the playback without a loss of sound is much more desirable than the slightly larger impacts.

In this instance, the central processing unit 8*a* not only modifies the on-velocities but also ignore the off-velocities. However, the central processing unit 8*a* of another automatic player piano according to the present invention may skip one of steps Sp3 and Sp4. Even so, the hammer return is accelerated, and the playback is prevented from the loss of sound. However, when both steps SP3 and SP4 are carried out, the playback is surely free from the loss of sound.

Even if the first note-on code has a small on-velocity, the attack-delay is very long, and the central processing unit may change the driving data code to a value determined by the original on-velocity before the arrival of the second note-on code. However, when the prevent inventors measured the attack delay during a repetition, the attack delay fell within the range indicated by hatching lines in FIG. 3B, and was maximized around 0.15 second. Therefore, it is seldom for the central processing unit to fetch the second note-on code after the determination of the touch data and the attack delay on the basis of the original on-velocity.

If an acoustic piano reciprocates the hammer in 0.3 to 0.4 second, the central processing unit 8*a* may skip step SP3. The control of the solenoid-operated actuator 11*a* without the modification at step SP3 results in the sound generation without a change of intensity of the impact, and the sound is generated at expected timings.

Although particular embodiments of the present invention have been shown and described, it will be obvious to those skilled in the art that various changes and modifications may be made without departing from the spirit and scope of the present invention.

For example, the timer may be implemented by a software, and the solenoid-operated actuators may be provided on the key bed.

A grand piano may be available for the automatic player piano according to the present invention instead of the upright piano.

An automatic player piano may be equipped with a hammer stopper which allows a player to practice a fingering on the keyboard without acoustic sounds by preventing the strings from an impact of the hammer head. The critical time interval may be changed from 0.5 second to an appropriate value depending upon the acoustic piano.

The value a may be variable depending upon the difference between the time interval t and the total time (A1+A2).

In the above described embodiment, the total time is calculated from the attack delays A1 an A2. However, an actual time interval may be measured by using, for example, hammer sensors provided around the impact point and the home position.

The value a may be added to one of the on-velocities NV1 and NV2.

Finally, the central processing unit 8*a* may multiply the on-velocities by a constant value b instead of the addition of the value a. The multiplication is desirable because the multiplication maintains the magnitude ratio between the on-velocities.

What is claimed is:

1. An automatic player piano comprising:

an acoustic piano including a plurality of keys respectively assigned notes of a scale and selectively depressed by a player, a plurality of hammer assemblies respectively associated with said plurality of keys, a plurality of strings respectively associated with said plurality of hammer assemblies and generating acoustic sounds respectively having said notes, and a plurality of key action mechanisms functionally connected between said plurality of keys and said plurality of hammer assemblies and transferring forces exerted on said plurality of keys so as to cause said plurality of hammer assemblies to strike said plurality of strings; and an electric system including a plurality of actuators respectively associated with said plurality of keys and selectively energized so as to exert said forces on said plurality of keys instead of said player, and a controlling unit selectively supplying driving signals to said plurality of actuators for selectively energizing said plurality of actuators, and having a source of music data information sequentially generating first pieces of music data information indicative of respective keys to be depressed and magnitudes of said forces and second pieces of music data information indicative of said respective keys to be released and decrements of said forces, a forecasting means enabled with at least two first pieces of music data information both indicative of a certain key of said plurality of keys to be depressed and deciding whether or not one of said plurality of strings associated with said certain key can repeatedly generates the acoustic sound on the basis of the magnitudes of said at least two first pieces of music data information, a modifying means for changing said magnitudes of said at least two first pieces of music data information when said forecasting means decides that said one of said plurality of strings can not repeatedly generates said acoustic sound, and a driving signal generating means responsive to said first pieces of music data information for changing said driving signals to respective values corresponding to said magnitudes and said second pieces of music data information for decreasing said magnitudes by said decrements.

2. The automatic player piano as set forth in claim 1, in which said forecasting means includes an estimating sub-means for estimating a time period consumed by a reciprocal motion of one of said plurality of hammer assemblies associated with said certain key when said driving signal is changed by using said magnitudes of said at least two first pieces of music data information without a modification by said modifying means, and a comparing sub-means for comparing said time period given by said estimating sub-means with a critical value so as to decide whether or not said one of said plurality of strings associated with said certain key can repeatedly generate said acoustic sound on the basis of said magnitudes of said at least two first pieces of music data information.

3. The automatic player piano as set forth in claim 2, in which said estimating sub-means converts said magnitudes of said at least two first pieces of music data information to touch data each indicative of an initial force exerted to said certain key and attack delays each indicative of a time period between an application of said initial force and an impact timing of said one of said plurality of hammer assemblies against said one of said string, and estimates said time period by adding said attack delays.

4. The automatic player piano as set forth in claim 1, in which said modifying means changes said magnitudes by adding a certain value thereto.

5. The automatic player piano as set forth in claim 4, in which said certain value is a constant.

6. An automatic player piano comprising:

an acoustic piano including a plurality of keys respectively assigned notes of a scale and selectively depressed by a player, a plurality of hammer assemblies respectively associated with said plurality of keys, a plurality of strings respectively associated with said plurality of hammer assemblies and generating acoustic sounds respectively having said notes, and a plurality of key action mechanisms functionally connected between said plurality of keys and said plurality of hammer assemblies and transferring forces exerted on said plurality of keys so as to cause said plurality of hammer assemblies to strike said plurality of strings; and an electric system including a plurality of actuators respectively associated with said plurality of keys and selectively energized so as to exert said forces on said plurality of keys instead of said player, and a controlling unit selectively supplying driving signals to said plurality of actuators for selectively energizing said plurality of actuators, and having a source of music data information sequentially generating first pieces of music data information indicative of respective keys to be depressed and magnitudes of said forces and second pieces of music data information indicative of said respective keys to be released and decrements of said forces, a forecasting means enabled with at least two first pieces of music data information both indicative of a certain key of said plurality of keys to be depressed and deciding whether or not one of said plurality of strings associated with said certain key can repeatedly generates the acoustic sound on the basis of the magnitudes of said at least two first pieces of music data information, a modifying means for changing the decrements of at least two second pieces of music data information relating to said at least two first pieces of music data information to a maximum value when said forecasting means decides that said one of said plurality of strings can not repeatedly generates said acoustic sound, and a driving signal generating means responsive to said first pieces of music data information for changing said driving signals to respective values corresponding to said magnitudes and said second pieces of music data information for decreasing said magnitudes by said decrements changed to the maximum value.

7. The automatic player piano as set forth in claim 6, in which said forecasting means includes an estimating sub-means for estimating a time period consumed by a reciprocal motion of one of said plurality of hammer assemblies associated with said certain key when said driving signal is changed by using said magnitudes of said at least two first pieces of music data information without a modification by said modifying means, and a comparing sub-means for comparing said time period given by said estimating sub-means with a critical value so as to decide whether or not said one of said plurality of strings associated with said certain key can repeatedly generate said acoustic sound on the basis of said magnitudes of said at least two first pieces of music data information.

8. The automatic player piano as set forth in claim 7, in which said estimating sub-means converts said magnitudes of said at least two pieces of music data information to touch data each indicative of an initial force exerted to said certain key and attack delays each indicative of a time period between an application of said initial force and an impact timing of said one of said plurality of hammer assemblies against said one of said string, and estimates said time period by adding said attack delays.

9. The automatic player piano as set forth in claim 6, in which each of said decrements specifies an initial force applied to said certain key when one of said plurality of hammer assemblies associated with said certain key strikes one of said plurality of strings and a time period between an application of said initial force and a removal of force from said certain key, said modifying means decreasing said initial force and said time period to zero.

10. An automatic player piano comprising:

an acoustic piano including a plurality of keys respectively assigned notes of a scale and selectively depressed by a player, a plurality of hammer assemblies respectively associated with said plurality of keys, a plurality of strings respectively associated with said plurality of hammer assemblies and generating acoustic sounds respectively having said notes, and a plurality of key action mechanisms functionally connected between said plurality of keys and said plurality of hammer assemblies and transferring forces exerted on said plurality of keys so as to cause said plurality of hammer assemblies to strike said plurality of strings; and an electric system including a plurality of actuators respectively associated with said plurality of keys and selectively energized so as to exert said forces on said plurality of keys instead of said player, and a controlling unit selectively supplying driving signals to said plurality of actuators for selectively energizing said plurality of actuators, and having a source of music data information sequentially generating first pieces of music data information indicative of respective keys to be depressed and magnitudes of said forces and second pieces of music data information indicative of said respective keys to be released and decrements of said forces, a forecasting means enabled with at least two first pieces of music data information both indicative of a certain key of said plurality of keys to be depressed and deciding whether or not one of said plurality of strings associated with said certain key can repeatedly generates the acoustic sound on the basis of the magnitudes of said at least two first pieces of music data information, a first modifying means for changing said magnitudes of said at least two first pieces of music data information when said forecasting means decides that said one of said plurality of strings can not repeatedly generates said acoustic sound, a second modifying means for changing the decrements of at least two second pieces of music data information relating to said at least two first pieces of music data information to a maximum value when said forecasting means decides that said one of said plurality of strings can not repeatedly generates said acoustic sound, and a driving signal generating means responsive to said first pieces of music data information for changing said driving signals to respective values corresponding to said magnitudes and said second pieces of music data information for decreasing said magnitudes by said decrements.

* * * * *